US007714520B2

(12) United States Patent
Liu

(10) Patent No.: US 7,714,520 B2
(45) Date of Patent: May 11, 2010

(54) LED DRIVER CIRCUIT CAPABLE OF ADJUSTING OUTPUT CURRENT

(76) Inventor: Da-Yi Liu, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 12/139,502

(22) Filed: Jun. 15, 2008

(65) Prior Publication Data

US 2009/0309510 A1 Dec. 17, 2009

(51) Int. Cl.
*H05B 37/02* (2006.01)

(52) U.S. Cl. ..... 315/291; 315/307

(58) Field of Classification Search ..... 315/185 R, 315/209 R, 224, 245, 247, 291, 307, 308
See application file for complete search history.

(56) References Cited

U.S. PATENT DOCUMENTS 7,312,783 B2 * 12/2007 Oyama ..... 345/102
7,423,389 B2 * 9/2008 Lee ..... 315/308
2006/0082332 A1 * 4/2006 Ito et al. ..... 315/291
2006/0192498 A1 * 8/2006 Ragonesi et al. ..... 315/209 R

* cited by examiner

*Primary Examiner*—Douglas W Owens
*Assistant Examiner*—Jimmy T Vu

(57) ABSTRACT

An LED driver circuit includes a power controller, a voltage regulator, a detecting resistor, a light emitting device, and a voltage detecting circuit. The voltage detecting circuit has a first input end connected to a higher potential end of the detecting resistor, and a second input end thereof is connected to a lower potential end of the detecting resistor. The output end of the voltage detecting circuit is connected to a feedback end of the power controller so as to output a detected voltage signal to the power controller for adjusting the output voltage and supplying a stable and proper value of current to the light emitting device. The voltage detecting circuit is a differential amplifier capable of detecting the voltage difference between the detecting resistor and amplifying it as a feedback to the power controller. Therefore, the output current from the power controller is precisely controlled.

3 Claims, 3 Drawing Sheets

LED DRIVER CIRCUIT CAPABLE OF ADJUSTING OUTPUT CURRENT

FIELD OF THE INVENTION

The present invention relates to driver circuits, and in particular to an LED driver circuit capable of adjusting the output current.

DESCRIPTION OF THE PRIOR ART

Light Emitting Diodes (LED) has advantages of small size, low power consumption, fast light up speed, vibration resistance, long life time, and suitable for mass production. Thus, LEDs are widely used as indicators and display devices in the information, communication, and consumer electronics product, and it will be more widely used in predictable future and take the place of the traditional illuminant device. As all we knows, an LED is operated under a positive bias state, while when the bias being supplied to the LED passes the startup voltage, the LED will be conducted and thus lights up, and the luminance comes greater with the current being supplied to the LED. Usually in a practical application, a driver circuit is used to provide a stable current to maintain stable luminance of the LED. The prior driver circuit is designed to supply fixed current for the purpose of lengthening the lifetime of the LED. As shown in FIG. 5, the prior LED driver circuit includes a power controller IC, light emitting device LEDs, a detecting resistor Rs, an input power source P, a reference voltage, a detecting voltage Vd, and an output voltage Vout.

The reference voltage Vref is a fixed voltage, and the detecting voltage Vd is a voltage drop caused by the output current ILed passing through the detecting resistor Rs. The power controller IC will adjust the output current ILed according to the two voltages for controlling the luminance of the LED. This kind of LED driver circuit is basically operated under voltage, it will maintain the voltage between the detecting resistor to keep the fixed current for operating the LED.

However, the power controller IC usually uses a pulse width modulation (PWM) or a pulse frequency modulation (PFM) to transform the input voltage to current for operating the LED. An input end of the power controller IC is connected to the input power source P and another input power source is connected to the reference voltage Vref. An output end of the power controller provides an output voltage to the LED, the detecting resistor is connected to a lower potential end of the LED and is grounded with another end thereof. The detecting point of the detecting voltage Vd is between the LED and the detecting resistor Rs, and thus the detecting voltage Vd is equal the voltage drop of the detecting resistor Rs. The detecting voltage Vd will be fed back to the power controller as a close loop, and the power controller will adjust the output voltage according to the difference of the reference voltage Vref and the detecting voltage Vd so as to be equal to those two voltages and to provide a stable and proper value of current.

In the prior technique, when the output voltage Vout is greater than the positive bias VLed capable of starting up the LED, the LED will light up by a driving current ILed and the value of the ILed is approximately developed in the following formula ILed=(Vout−VLed)/Rs. The power controller IC will adjust the output current according to the difference of the reference voltage Vref and the detecting voltage Vd to precisely control the luminance of the LED. Although the prior driver circuit is capable of controlling the luminance of the LED, a large part of the power is consumed by the detecting resistor Rs so that the power being supplied to the LED is lowered and thus the efficiency of the prior driver circuit is low. Besides, the power consumed by the detecting resistor Rs will transform to heat and cause a lot of disadvantageous effects to the circuit. To lower the heat issue, it is usually to lower the reference voltage and shrink the detecting resistor Rs, but the smaller the resistor is, the higher cost and higher error the resistor takes. Therefore, the cost of the driver circuit is getting higher and there are issues of precision on power supplying. For example, the error of the current control of the driver circuit will reach 10% and more because of the error of detecting resistor Rs, reference voltage, and the loss of the circuit. The current noise caused by above error will limit the performance of the LED. For example, an LED of an operation current specification of 1 A will be designed to be operated in 900 mA because of the current control issue. While using, the current being supplied to the LED is about 810 mA to 990 mA, the illuminant efficiency is serious damaged.

SUMMARY OF THE PRESENT INVENTION

Accordingly, the primary object of the present invention is to provide an improved LED driver circuit which uses a differential amplified signal of voltage difference of the detecting resistor as a reference for the power controller to adjust the output voltage so as to provide a stable and proper value of current to the LED.

A secondary object of the present invention is to provide an improved LED driver circuit which is capable of lowering the current noise by the precise output current control of the differential amplifier so as to promote the average luminance and the maximum operation power of the LED.

Another object of the present invention is to provide an improved LED driver circuit which is capable of lowering the power consumption of the detecting resistor to raise the efficiency of driver circuit and avoid the high cost and high error of shrinking the detecting resistor.

A yet object of the present invention is to provide an improved LED driver circuit an output current of which is easy to be adjusted. The current specification demanded by a customer can be achieved by modifying the ratio of the resistances of a voltage detecting circuit without needing to change any circuit so that no additional design cost or manufacturing technique needs to be concerned.

A still object of the present invention is to provide an improved LED driver circuit including an adjustable resistor for adjusting the amplifying ratio of the differential amplifier. The output current can be adjusted by the needs to control the luminance of the LED.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
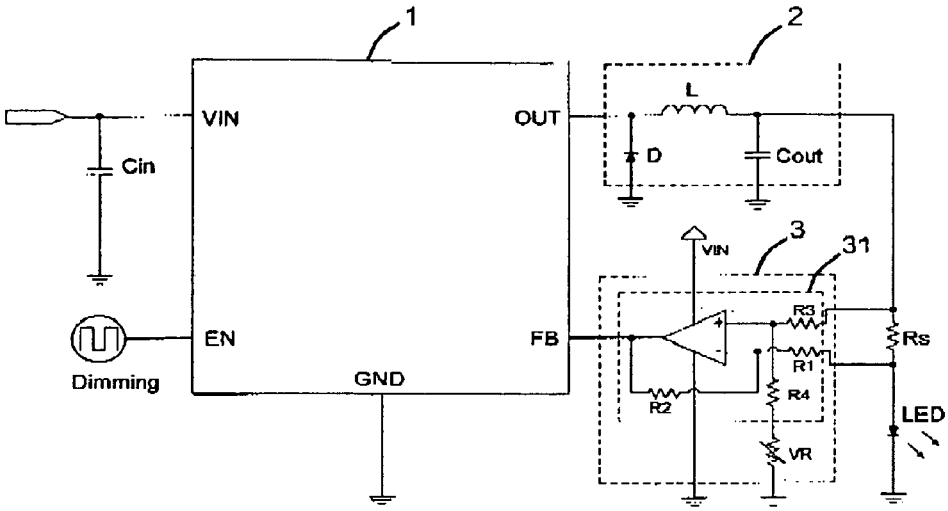
FIG. 1 is an electrical drawing of a preferred embodiment of the present invention.

Referring to FIG. 1, a preferred embodiment of the present invention is illustrated, in that, an LED driver circuit mainly includes a power controller 1, a voltage regulator 2, a voltage detecting circuit 3, a detecting resistor Rs, and a light emitting device LED. The connection of the units is shown in FIG. 1. An input end VIN of the power controller 1 is connected to a power source. An output end of the power controller 1 is connected to the voltage regulator 2. The voltage regulator 2 connects the detecting resistor Rs and the LED. A feedback end FB of the power controller 1 is connected to an output end of the voltage detecting circuit 3. The voltage detecting circuit 3 has a first input end connected to a higher potential end of the detecting resistor Rs and a second input end thereof connected to a lower potential end of the detecting resistor Rs.

In the embodiment of the present invention, the power controller 1 is a Pulse Width Modulation (PWM) controller. In fact, PWM is not the only choice for the power controller 1, it also can be a Pulse Frequency Modulation (PFM) or a regular power transformer including a DC TO DC or AC TO DC power IC, or a power IC for raising or lowering voltage. A DC or AC power source being front processed such as regulating, filtering, raising or lowering is connected to the input end VIN of the power controller 1. The output end OUT of the power controller 1 connects the input end of the voltage regulator 2. An output enabling end EN of the power controller 1 has a Dimming Function of tuning the luminance of the LED. A GND end of the power controller 1 is grounded. The feedback end FB of the power controller 1 is connected to an output end of the detecting circuit 3. Moreover, a reference voltage which is a fixed voltage is set in the power controller 1.

The voltage regulator 2 provides a driving voltage to the detecting resistor Rs and the LED. The voltage regulator 2 includes a filtering inductance L which is serially connected between the input end and the output end of the voltage regulator 2. The voltage regulator 2 further includes a filtering capacity Cout which is connected to the output end of the voltage regulator 2 in one end and is grounded in another end thereof. The voltage regulator 2 has a Freewheel diode D which is connected to the input end of the voltage regulator 2 in one end and grounded in another end thereof.

The detecting resistor Rs is serially connected to the output end of the voltage regulator 2 and the LED which is grounded in another end thereof. The light emitting device LED can be one LED or a serial-connected LED set, a parallel-connected LED set, a serial and parallel-connected LED set, or an LED array.

Figure 2:
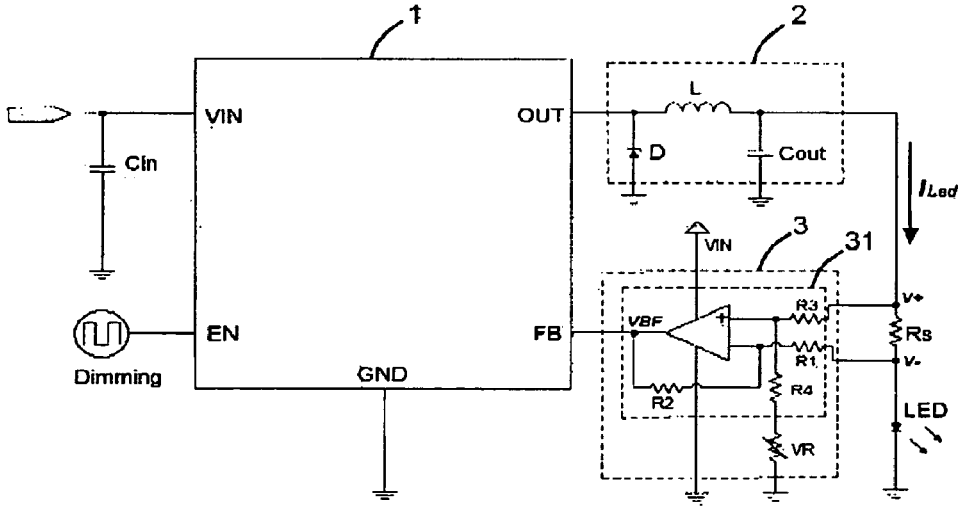
FIG. 2 is a schematic view showing the operation of the circuit shown in FIG. 1.

The voltage detecting circuit 3 includes a differential amplifier 31 and an adjustable resistor VR. The differential amplifier 31 includes resistors R1, R2, R3, and R4. The first input end of the differential amplifier 31 is serially connected with the resistor R3 and then is connected to the high potential end of the detecting resistor Rs, and one end of the resistor R4 is connected between the first input end of the difference amplifier 31 and the resistor R3 and then serially connected to a grounded adjustable resistor VR. On the other hand, the second input end of the differential amplifier 31 is serially connected with the resistor R1 and then is connected to the lower potential end of the detecting resistor Rs, and the resistor R2 is connected between the second input end of the differential amplifier 31 and the output end of the differential amplifier 31. Moreover, the output end of the difference amplifier 31 is the output end of the voltage detecting circuit 3. The two power source connections of the differential amplifier 31 are connected to the power input end VIN of the power controller 1 and ground. With reference to FIG. 2, the differential amplifier will give an output VFB by using the following formula:

$$VFB = \left(\frac{R1 + R2}{R3 + (R4 + VR}\right)\frac{(R4 + VR)}{R1}(V+) - \frac{R2}{R1}(V-)$$

According to the above structure, the first and the second input ends of the differential amplifier 31 of the present invention are connected to both ends of the detecting resistor Rs to detect the voltage difference of the detecting resistor Rs[ΔV=(V+)−(V−)]. The voltage difference will be differentially amplified by the circuit of R1, R2, R3, and R4. The voltage difference will be amplified by n times (n=R2/R1 or R4/R3) so as to give the output VFB. The differential amplified signal will be sent to the feedback end FB of the power controller 1. The power controller 1 will adjust the output voltage according to the difference between the VFB and the reference voltage so as to supply a proper and stable current to the light emitting device. Moreover, the differential amplifier will lower the noise of the output current to 1/n of that it generally used, and thus a more precisely output current will be provided and the luminance of the LED will be uniformly with nearly full illuminant efficiency. Otherwise, the adjustable resistor VR in the voltage detecting circuit 3 can adjust the amplifying ratio of the differential amplifier. The output current can be tuned for a practical need by adjusting the resistance of the adjustable resistor VR without an additional switch for controlling the luminance of the LED.

A practical example will be explained in the following condition. For example, the resistance of the detecting resistor Rs is 0.1Ω. The resistances of the resistor R1 and R3 are both 1KΩ, and the resistances of the resistor R2 and R4 are both 10KΩ. The reference voltage of the power controller 1 is set to 1.23V, and the adjustable resistor VR can be tuned from 0 to 10KΩ. Based on these settings, when the adjustable resistor VR is set to 0Ω and assuming the output current ILed is 1.2 A, the voltage difference between the detecting resistor Rs will be $$\Delta V = 1.2\ A \times 0.1\Omega = 0.12V,$$

and the differential amplified voltage VFB will be $$VFB = [(R1+R2)/(R3+R4)] \times R4/R1 \times (V+) - R2/R1 \times (V-),$$

while R2/R1=R4/R3, $$VFB = R2/R1 \times \Delta V = 10K/1K \times 0.12V = 1.2V$$

The differential amplified voltage VFB is 1.2V and it is smaller than the reference voltage which is 1.23V. Thus the power controller 1 will raise the output voltage and further to raise the output current ILed.

When the output current ILed is raised to 1.23 A, the voltage difference between the detecting resistor Rs is ΔV=1.23 A×0.1Ω=0.123V. The differential amplified voltage VFB will become $$VFB = R2/R1 \times \Delta V = 10K/1K \times 0.123V = 1.23V.$$

Therefore, the differential amplified voltage VFB is equal to the reference voltage which is 1.23V, and the output voltage of the power controller 1 will be fixed so as to supply a fixed current of 1.23 A to the light emitting device.

Accordingly, the output current of the power controller can be adjusted by means of the differential amplifier of the present invention, the precision of the output current will be well improved and with an error less than 0.5%. By the precise output current, an LED with specification of 1 A operation current can be designed as operating with driving current under 995 mA. The driving current supplied to the LED will between 990.025 to 999.975 mA, the luminance of the LED is stable and also the illuminant efficiency is nearly maximum. Moreover, by the differential amplifier 31 and the adjustable resistor VR of the present invention, the resistance of the detecting resistor Rs can be lowered to less than 1Ω from a prior one of 10 KΩ or higher. Therefore, all the output power can be used on the light emitting device to improve the power efficiency and save the power, meanwhile to avoid the high cost and error for shrinking the detecting resistor. Moreover, the output current adjustment of the present invention is simple, the value demanded by a customer can be achieved by modifying the ratio of the resistors R1 to R4 without changing any circuit so that no additional design cost or manufacturing technique needs to be concerned.

Figure 3:
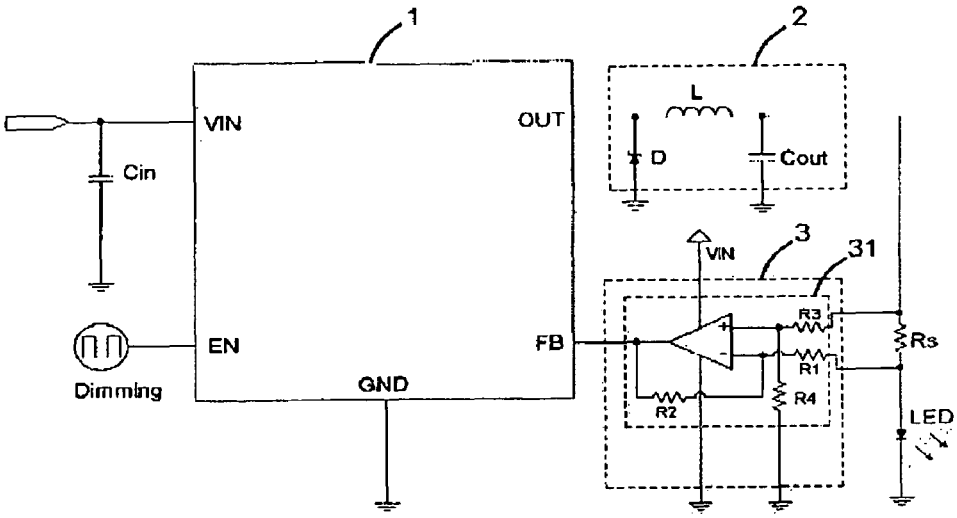
FIG. 3 is an electrical drawing of another preferred embodiment of the present invention.
Figure 4:
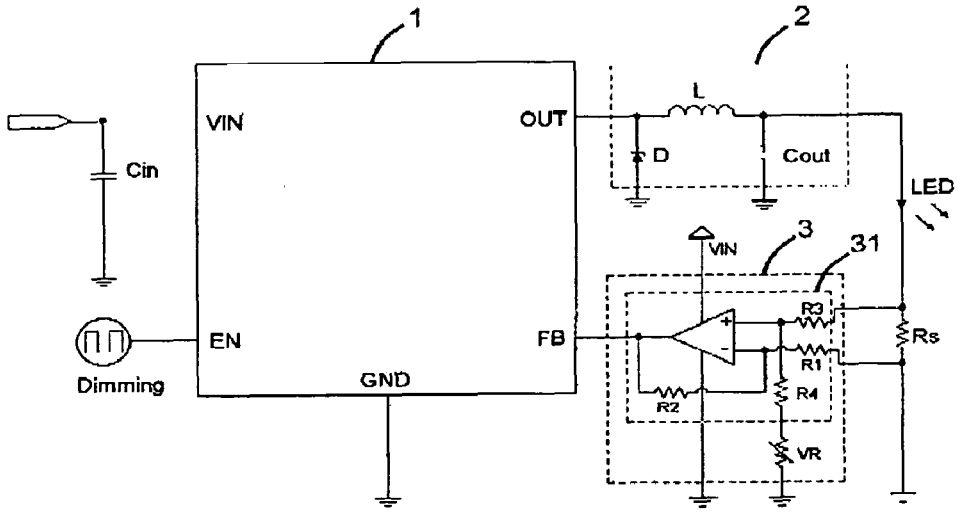
FIG. 4 is an electrical drawing of one another preferred embodiment of the present invention.
Figure 5:
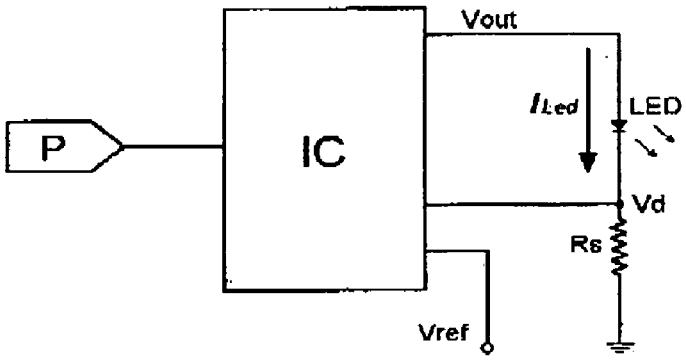
Fig. 5 (PRIOR ART)
FIG. 5 is an electrical drawing of a prior LED driver circuit.

The present invention is thus described, it will be obvious that the same may be varied in many ways. For example, there is no adjustable resistor VR arranged in the voltage detecting circuit 3 and the resistor R4 of the difference amplifier 31 will directly be grounded (as shown in FIG. 3). Or, the light emitting device is connected between a higher potential end of the detecting resistor Rs and the output end of the voltage regulator 2 and the lower potential end of the detecting resistor Rs is grounded (as shown in FIG. 4). Such variations are not to be regarded as a departure from the spirit and scope of the present invention, and all such modifications as would be obvious to one skilled in the art are intended to be included within the scope of the following claims.

What is claimed is:

1. An LED driver circuit comprising:

a power controller having an input end connected to a power source and a reference voltage;

a voltage regulator connected to a voltage output end of the power controller;

a detecting resistor connected to an output end of the voltage regulator for receiving an output current of the voltage regulator;

a light emitting device formed by at least one LED and serially connected to the detecting resistor and one end the light emitting device being grounded; and a voltage detecting circuit having a first input end connected to a high potential end of the detecting resistor and a second input end connected to another end of the detecting resistor; the output end of the voltage detecting circuit being connected to a feedback end of the power controller so as to output a detecting voltage signal to the power controller; the power controller adjusting the output voltage according to the voltage difference between the detecting voltage signal and the reference voltage so as to output a stable current with a predetermined value to the light emitting device; and wherein the voltage detecting circuit is a differential amplifier; and wherein the differential amplifier has the first input end, the second input end, and the detecting voltage signal output end; the differential amplifier further includes resistors R1, R2, R3, and R4; the first input end of the differential amplifier is serially connected with the resistor R3 and then connects to the high potential end of the detecting resistor, and one end of the resistor R4 is connected between the first input end of the differential amplifier and the resistor R3 and is grounded with another end; the second input end of the differential amplifier is serially connected with the resistor R1 and then connects to the lower potential end of the detecting resistor, and the resistor R2 is connected between the second input end of the differential amplifier and the output end of the differential amplifier; and the output end of the differential amplifier is the output end of the voltage detecting circuit.

2. The LED driver circuit as claimed in claim 1, wherein the light emitting device can be one LED or a serial-connected LED set, a parallel-connected LED set, a serial and parallel-connected LED set, or an LED array.

3. An LED driver circuit as claimed in claim 1, wherein the voltage detecting circuit has an adjustable resistor which is serially connected between the resistor R4 and ground.

* * * * *